US007086510B2

(12) United States Patent
Smith et al.

(10) Patent No.: US 7,086,510 B2
(45) Date of Patent: Aug. 8, 2006

(54) EXPANDABLE LUGGAGE AND EXPANSION MECHANISM

(75) Inventors: Robert Smith, Louisville, CO (US); Doug Golenz, Louisville, CO (US); Andy Burgess, St. Louis, MO (US); Aaron Gorga, St. Louis, MO (US); Jeff Mullins, St. Louis, MO (US); Daniel Kim, Appleton, WI (US)

(73) Assignee: TRG Group, L.L.C., St. Louis, MO (US)

( * ) Notice: Subject to any disclaimer, the term of this patent is extended or adjusted under 35 U.S.C. 154(b) by 166 days.

(21) Appl. No.: 10/670,760

(22) Filed: Sep. 25, 2003

(65) Prior Publication Data

US 2005/0067244 A1 Mar. 31, 2005

(51) Int. Cl.
*A45C 7/00* (2006.01)

(52) U.S. Cl. ..... 190/103; 190/14; 190/21; 220/8; 383/2

(58) Field of Classification Search ..... 190/14, 190/15 R, 21, 22, 103–105; 220/8; 383/2, 383/33

See application file for complete search history.

(56) References Cited

U.S. PATENT DOCUMENTS

| | | | | | |
|---|---|---|---|---|---|
| 440,278 | A | * | 11/1890 | Payntar | 190/105 |
| 587,487 | A | * | 8/1897 | Palica | 190/22 |
| 701,440 | A | * | 6/1902 | Wilkinson | 190/105 |
| 710,037 | A | * | 9/1902 | Bodwell, Jr. | 190/104 |
| 764,144 | A | | 7/1904 | McGowan | |
| 1,052,018 | A | * | 2/1913 | Spitz | 295/4 |
| 1,756,775 | A | * | 4/1930 | Winning | 292/281 |
| 2,096,768 | A | * | 10/1937 | Styll | 190/100 |
| 2,110,617 | A | * | 3/1938 | nee Saling | 190/105 |
| 2,475,961 | A | * | 7/1949 | Hilbert | 190/105 |
| 3,321,053 | A | * | 5/1967 | Doppelt | 190/104 |
| 3,450,237 | A | | 6/1969 | Dyke | |
| 3,504,772 | A | | 4/1970 | Barry | |
| 3,587,795 | A | | 6/1971 | Barry et al. | |
| 4,128,150 | A | | 12/1978 | Popkin et al. | |
| 4,356,899 | A | | 11/1982 | Tawil | |
| 4,773,515 | A | | 9/1988 | Kotkins, Jr. | |
| 4,787,488 | A | | 11/1988 | Campanini | |
| 4,813,520 | A | | 3/1989 | Lin | |
| 4,844,214 | A | * | 7/1989 | Castelli et al. | 190/103 |
| 4,844,215 | A | * | 7/1989 | Ambasz | 190/105 |
| 4,846,319 | A | | 7/1989 | Sadow | |

(Continued)

FOREIGN PATENT DOCUMENTS

EP 0189007 A1 * 7/1986

OTHER PUBLICATIONS

"New NXpandables", www.briggs-riley.com/home.html (Aug. 15, 2002).

*Primary Examiner*—Sue A. Weaver
(74) *Attorney, Agent, or Firm*—Armstrong Teasdale LLP

(57) ABSTRACT

An expansion mechanism for use with a piece of luggage, the expansion mechanism being designed to resiliently support, but not rigidly lock, a piece of expandable luggage in an extended position. The expansion mechanism allows for float at intermediate positions between a collapsed and extended position further preventing damage to the mechanism by allowing it to internally shift to compensate for shocks, and to allow the mechanism to continue to function even if it is bent or damaged. The expansion mechanism also allows for moveable parts of the mechanism and pinch points to be protected from interaction with the contents of the luggage.

18 Claims, 13 Drawing Sheets

U.S. PATENT DOCUMENTS 4,854,430 A 8/1989 Peterson
4,953,673 A 9/1990 Ambasz
5,080,206 A 1/1992 Tawil
5,082,094 A * 1/1992 Nechushtan ..... 190/105
5,314,046 A 5/1994 Pedrini
5,671,831 A 9/1997 Chiu
5,749,446 A 5/1998 Hsieh
5,819,891 A * 10/1998 Wang et al. ..... 190/103
6,021,874 A 2/2000 Nykoluk
6,022,146 A 2/2000 Bull
6,059,078 A 5/2000 Nykoluk
6,220,411 B1 4/2001 Scicluna et al.
6,227,397 B1 * 5/2001 Kim ..... 220/8
6,305,513 B1 10/2001 Lu
6,390,259 B1 5/2002 Lu
6,408,997 B1 6/2002 Chen
6,533,087 B1 3/2003 Chen
6,575,272 B1 6/2003 Krulik et al.
6,591,950 B1 7/2003 Scicluna
2002/0040834 A1 4/2002 Chen
2002/0125277 A1 9/2002 Lim et al.
2002/0130004 A1 9/2002 Lin
2002/0153216 A1 10/2002 Krulik
2002/0185350 A1 12/2002 Chang et al.

* cited by examiner

EXPANDABLE LUGGAGE AND EXPANSION MECHANISM

BACKGROUND OF THE INVENTION

1. Field of the Invention

This disclosure relates to the field of expandable luggage, in particular to expandable luggage utilizing an expansion mechanism to help support the luggage in the expanded state.

2. Description of the Related Art

The needs of travelers for transport space in their luggage can vary considerably. Some factors to consider are the duration of a trip, the type of trip (whether business or pleasure), the destination of the trip, and the activities to be performed during the trip. For instance, a user on a short trip will generally require less space for packing than a user on a long trip. By the same token, a user on a business trip often requires less clothing than on a pleasure trip where both dress and casual clothes may be needed. A traveler to a warm climate will also generally require less storage space than one going to a cold climate as warm weather clothes are generally less bulky.

Because of aircraft and airport luggage restrictions for both carry-on and checked baggage, travelers generally do not want to carry suitcases that are the incorrect size for their needs as the last thing a traveler wants to do is be forced to check a half empty piece of luggage, or be forced to deal with a large number of small pieces of luggage as they can be difficult to carry and keep track of and may not be allowed on the airplane.

To deal with these problems, many travelers own a multiplicity of luggage of various different sizes, shapes, and/or styles. They can then select the appropriate luggage for the particular type of trip they are currently taking so as to have a luggage that is not too large or too small. The problem with this situation is that it requires the luggage owner to own a number of pieces of luggage to be able to have the selection to chose from. Many pieces of luggage, even so-called soft-sided luggage (which generally include a rigid frame), are not collapsible and therefore storage of the selection of luggage can take up quite a lot of space. Further, even if the user selects the correct piece of luggage for the original trip, they may make purchases or otherwise acquire items at their destination requiring a larger piece of luggage for their return trip than was required for their initial trip.

To try and combat this problem, various types of expandable luggage have been developed. The simplest of these is a duffel bag, bag, or purse which is simply manufactured of a flexible material without any rigid structure. These can then be compressed into another suitcase for travel and unfolded and used for transport if additional space is later needed. The problem with these, however, is that they provide no shape to the luggage which can result in damage to the luggage or contents depending on what is carried and may not be suitable for some types of use. Further, many of these bags do not seal and so may not be used as checked luggage.

Another proposed solution to the problem has been the design of various expansible luggage or luggage of variable volume. This luggage generally has two portions or frames which are moveable relative to each other so that in a first configuration the luggage has a predetermined first volume, and in the second configuration a predetermined second volume which is greater than the first. These types of luggage can have all sorts of different designs. Some designs utilize zipped flaps which when unzipped allow a piece of flexible material to be extended between the two frames, the material then forming a portion of the outer wall of the luggage allowing for a larger internal volume.

While this design has its advantages, a distinct disadvantage is that there is no support for the flexible section. Therefore, the frames will often not naturally sit in the expanded position. This can make packing difficult. In particular, because of the design of the frames of soft sided or hard-sided luggage, the two frames are generally above each other with the flexible section between them when the luggage is being loaded. The weight of the top frame will generally collapse the flexible section meaning that the bag is often loaded to a guessed volume, and then the upper frame is lifted by the user to determine if the fill is correct.

To try and make expansible bags easier to load, a variety of expansion mechanisms or "expanders" have been proposed. These are devices which serve to provide a rigid or semi rigid support to the upper frame holding the frames apart to retain their spaced position. In this way, the flexible section is not collapsed as the two frames are held or supported at a particular distance from each other by the expansion mechanism. As the expansion mechanism serves to hold the bag in the expanded position, it improves ease of packing by holding the bag at the larger internal volume while the bag is being packed.

There are a plethora of problems with existing designs for expansion mechanisms. In many of the designs, the expansion mechanism maintains the positioning through a rigid locking of the expander in one or more positions which expand the volume of the luggage. The user moves the expander to a desired position for a particular expansion, and then locks it rigidly into place. To move the two frame pieces relative to each other to collapse the luggage, the user releases the lock, moves the expander, and then reengages the lock. These locks range from pins, to ratcheting mechanisms, to rotating cam locks. For weight reasons, these expanders are regularly constructed of lightweight plastic components and fabrics.

While these systems promote ease of use when loading the bag, they can present problems when the bag is in use. In particular, when a bag is expanded, it may or may not be fully loaded, or may be loaded with compressible items. In either case, baggage is often treated quite roughly by baggage handlers in loading or unloading the aircraft, and in transferring baggage from the airline to the user. It is, therefore, not surprising for a large force to be applied to the baggage. Because of these system's rigid locking mechanisms holding them in the expanded state, such a force can quite easily break the locking mechanism by snapping pins, teeth, or similar components which serve to lock the expansion mechanism in the extended position. This can destroy the functionality of the expansion device rendering it completely unusable and resulting in a costly repair.

In still other systems, the expander may comprise a plate rigidly held between rails or within a socket. These systems provide for increased rigidity to prevent the frames from moving relative to each other, and provide for a more rigidly sliding structure. Even if a force on the luggage is not from the correct angle to damage the locking mechanism, such as if a shearing force is applied, the plates or rails may be bent or even broken by the force. Because these systems rely on precise distances, designs, and relationships for smooth extension by sliding portions, a bend or break can easily prevent the expansion mechanism from operating as the bend or break results in a bind in the system, locking it to a particular position or subset of desired positions as the parts can no longer slide. In some cases, the force could be hard enough to break the plate, break the rails, or separate the plate from the rails. The problem is akin to a rail car wherein, if the wheel or tracks are damaged or bent, the train can easily derail.

A still further problem with the systems of the prior art is that they allow moving components of the expansion mechanisms to interact with the contents of the luggage. In particular, clothing or other items already placed in the luggage can be caught in moving parts of the expansion mechanism which extend into an already packed volume. This can both damage the mechanism and can result in damage to the items placed in the luggage. There can also be dirt or lint buildup in the system resulting in additional chances for binding

SUMMARY

Because of these and other problems in the art, described herein is an expansion mechanism for use with a piece of luggage, the expansion mechanism being designed to resiliently support, but not rigidly lock, a piece of expandable luggage in an extended position. Further, the expansion mechanism allows for float at intermediate positions between a collapsed and extended position further preventing damage to the mechanism by allowing it to internally shift to compensate for shocks, and to allow the mechanism to continue to function even if it is bent or damaged. Still further, the expansion mechanism allows for moveable parts of the mechanism and potential pinch points to be protected from interaction with the contents of the luggage.

There is described herein, in an embodiment, a piece of luggage comprising: a first frame having a perimeter and an open side; a second frame having a perimeter and an open side; a strip of flexible material attached to the perimeters of both of the frames around the open sides such that the first frame and the second frame enclose a volume which can be increased by moving the second frame away from the first frame and unfolding the strip of flexible material; and an expansion mechanism, the mechanism including a front protective plate attached to the first frame; an expansion plate attached to the second frame; and a lifting mechanism allowing the front protection plate to be moved relative to the expansion plate from a collapsed position to an extended position; wherein, when the front protective plate is moved relative to the expansion plate from the collapsed position to the extended position, the second frame is moved away from the first frame unfolding the strip of material and increasing the volume; and wherein, at a point between the extended position and the collapsed position, the expansion plate is not in contact with the front protective plate.

In an embodiment, the expansion plate and the front protective plate are resiliently supported in the extended position, such that if a force is applied to the expansion plate in a direction to return the expansion plate and the front protective plate to the collapsed position, the expansion plate will move to the collapsed position without damage to the expansion mechanism. In an embodiment, the expansion plate is trapezoidal in shape.

In another embodiment, at the extended position, the expansion plate is pinched by a portion of the front protective plate, which may comprise stoppering by the expansion plate.

In another embodiment, the luggage further comprises a second expansion mechanism attached to an opposing side of the luggage.

In another embodiment, in the extended position, the expansion plate is in contact with tabs on the front protective plate, such as by having tabs in contact with a surface of a cut-out in the expansion plate.

In another embodiment, the lifting mechanism comprises a handle for sliding a pushing pin in a slot. The lifting mechanism may also rotate about an axis fixed relative to the front protective plate.

In still another embodiment, there is described herein, a luggage expansion mechanism comprising: a front protective plate; an expansion plate which can move relative to the front protective plate from a collapsed position to an extended position and back again; and a lifting mechanism, arranged so that movement of the lifting mechanism causes the expansion plate to move relative to the front protective plate; wherein, the expansion plate is resiliently detained in the extended position by the lifting mechanism in a manner such that if a force is applied directly to the front protective plate and the expansion plate when in the extended position to move to the collapsed position, the expansion plate and the front protective plate can so move without damage to the luggage expansion mechanism.

DESCRIPTION OF PREFERRED EMBODIMENT(S)

Disclosed herein, among other things, are pieces of luggage including expansion mechanisms, an expansion mechanism, and methods for using an expansion mechanism. While the systems and methods discussed herein are primarily discussed in conjunction with soft-sided luggage, the expansion mechanism could also be used in conjunction with other luggage such as hard-sided luggage, trunks, bags, or with luggage having alternative designs or shapes.

Figure 6:
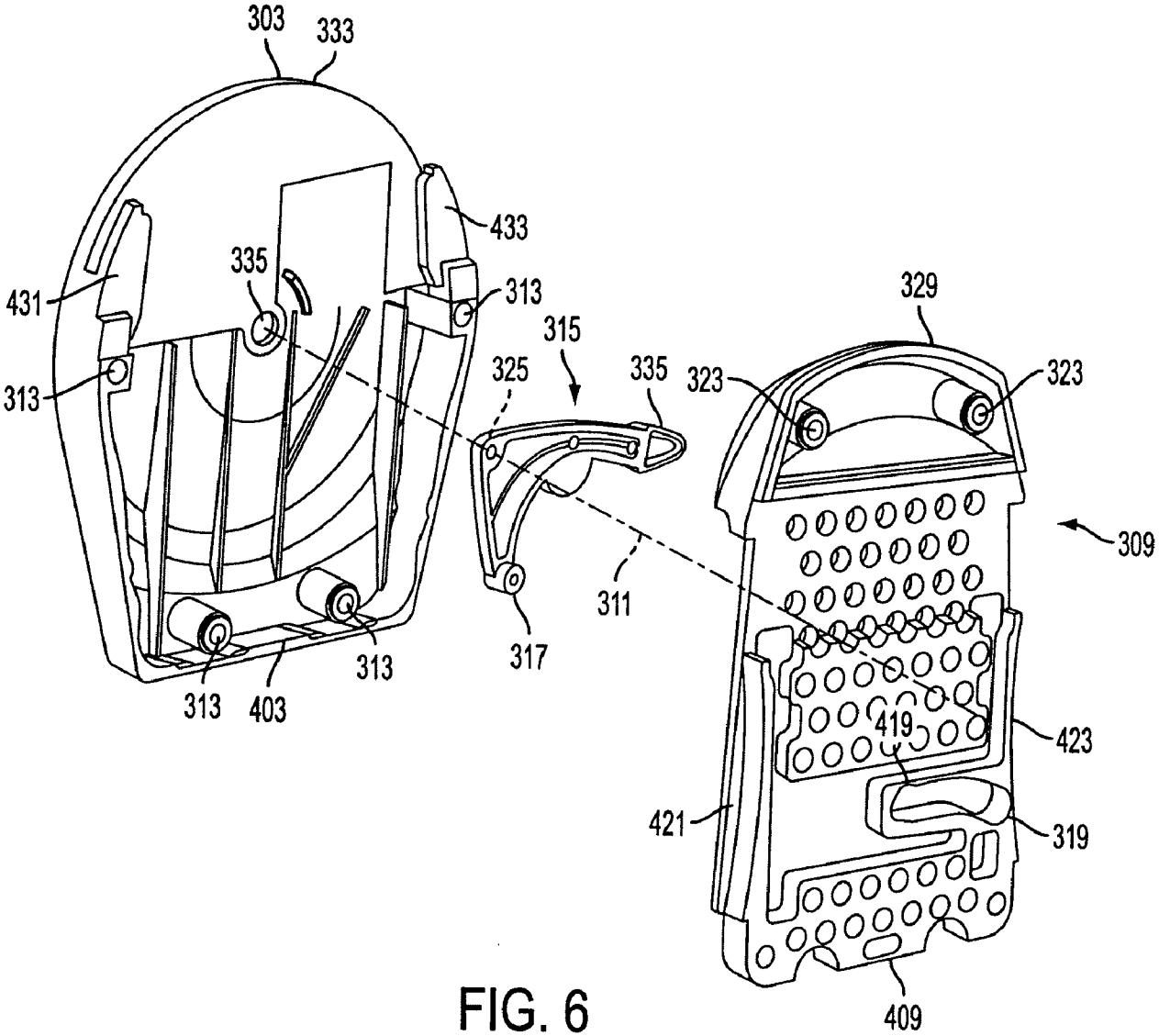
FIG. 6 shows an exploded view of the expansion mechanism.
Figure 7:
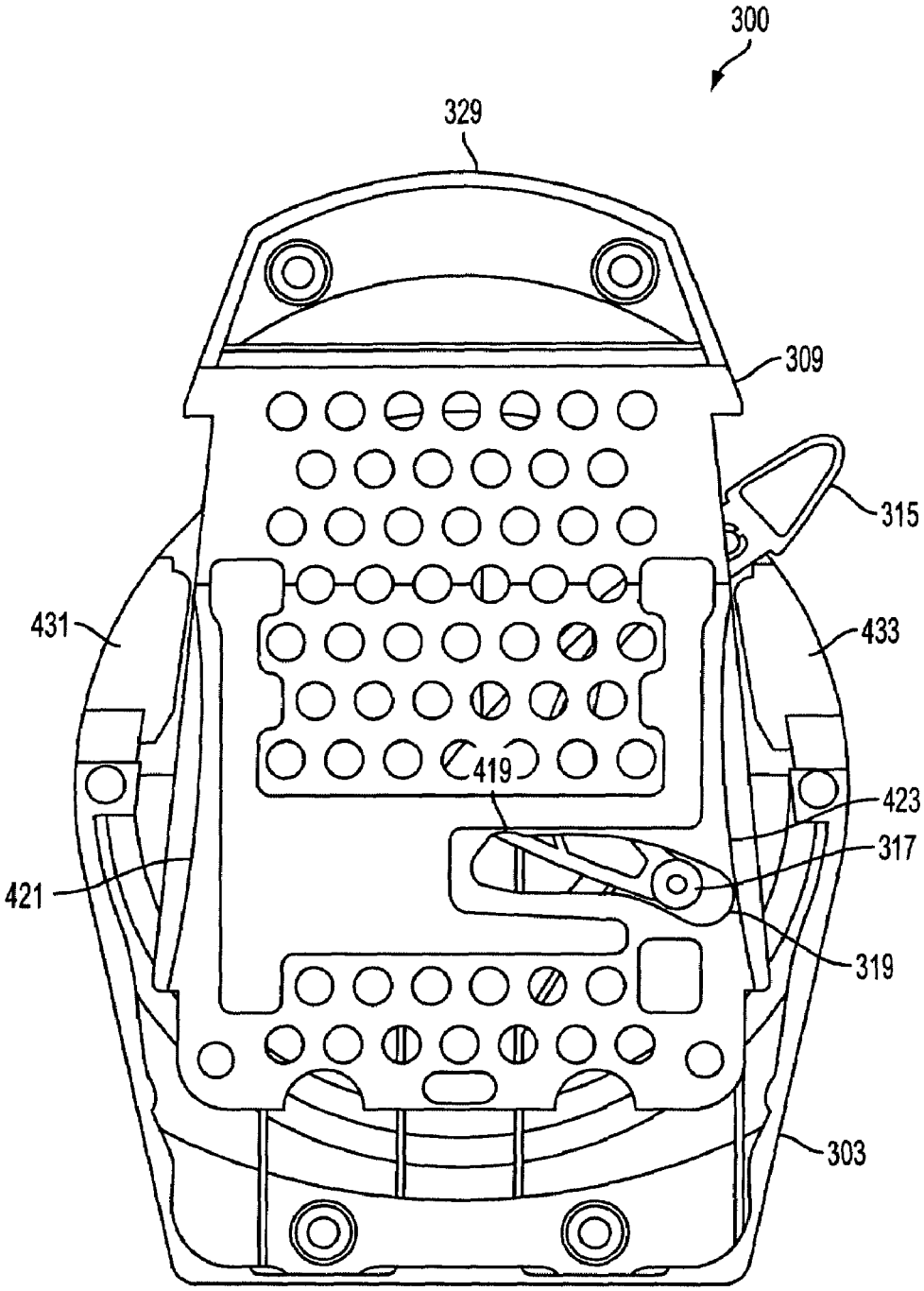
FIG. 7 shows the expansion mechanism in transit between a collapsed and expanded state.
Figure 8:
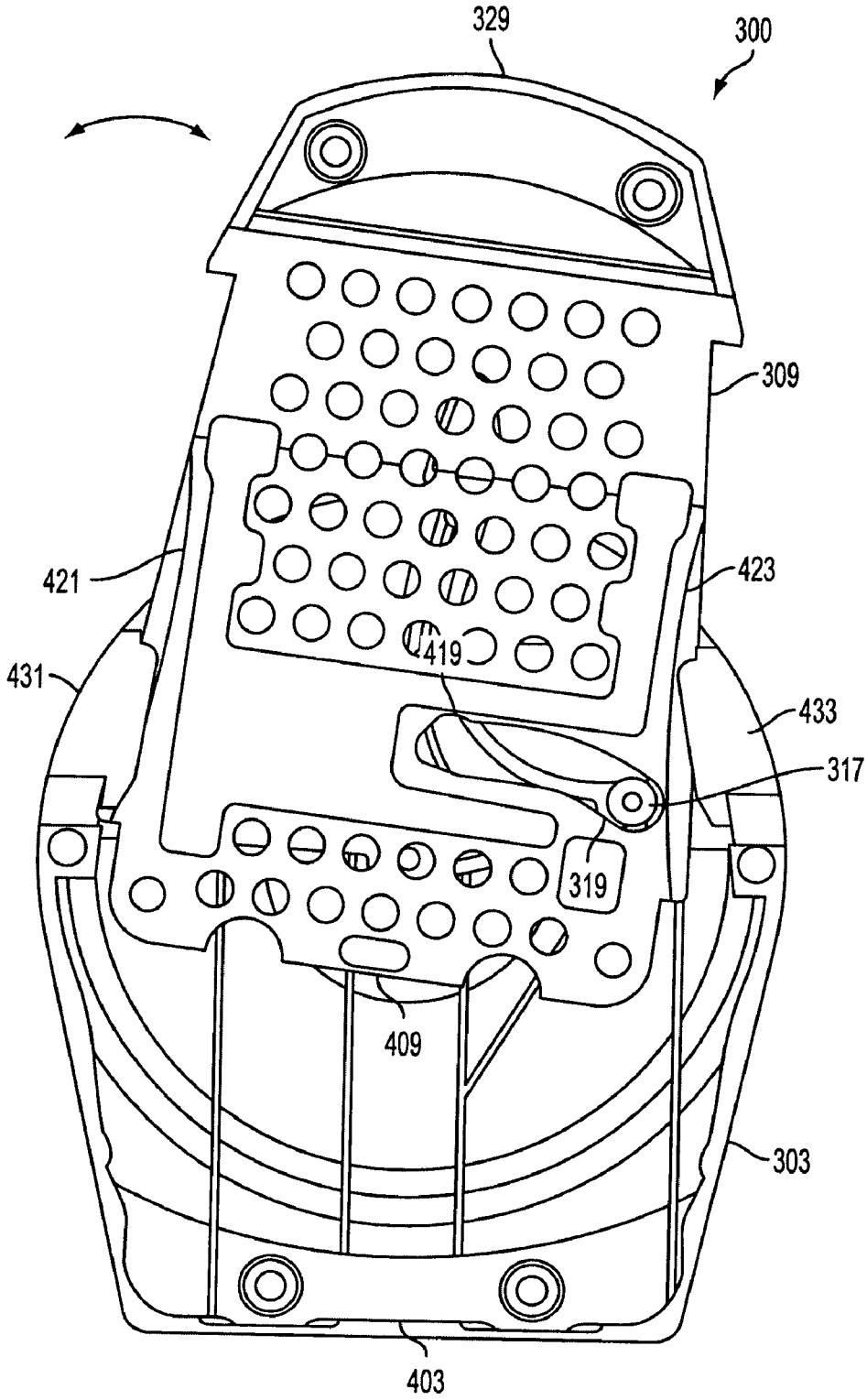
FIG. 8 shows the expansion mechanism in a deflected position to avoid damage.

For easy reference, many of the FIGS. included herewith have two sub labels. FIGS with the same number depict the same embodiment of the invention from the same angle, however the "A" figure shows the luggage or expansion mechanism in the collapsed state while the "B" figures show the luggage or expansion mechanism in the expanded state. For simplicity, this disclosure will refer at times to the expanded or collapsed state. Such a reference is intended to indicate the state of the "B" and "A" figures respectively. One of ordinary skill in the art would understand that the embodiments depicted in the FIGS. and other embodiments of the invention can be moved from the collapsed to expanded configurations or vice versa as part of the design of the invention. FIGS. 7 and 8 show an embodiment at an instant between the collapsed and expanded position and FIG. 6 shows an embodiment of the parts of an expansion mechanism in an exploded view.

Figure 1A:
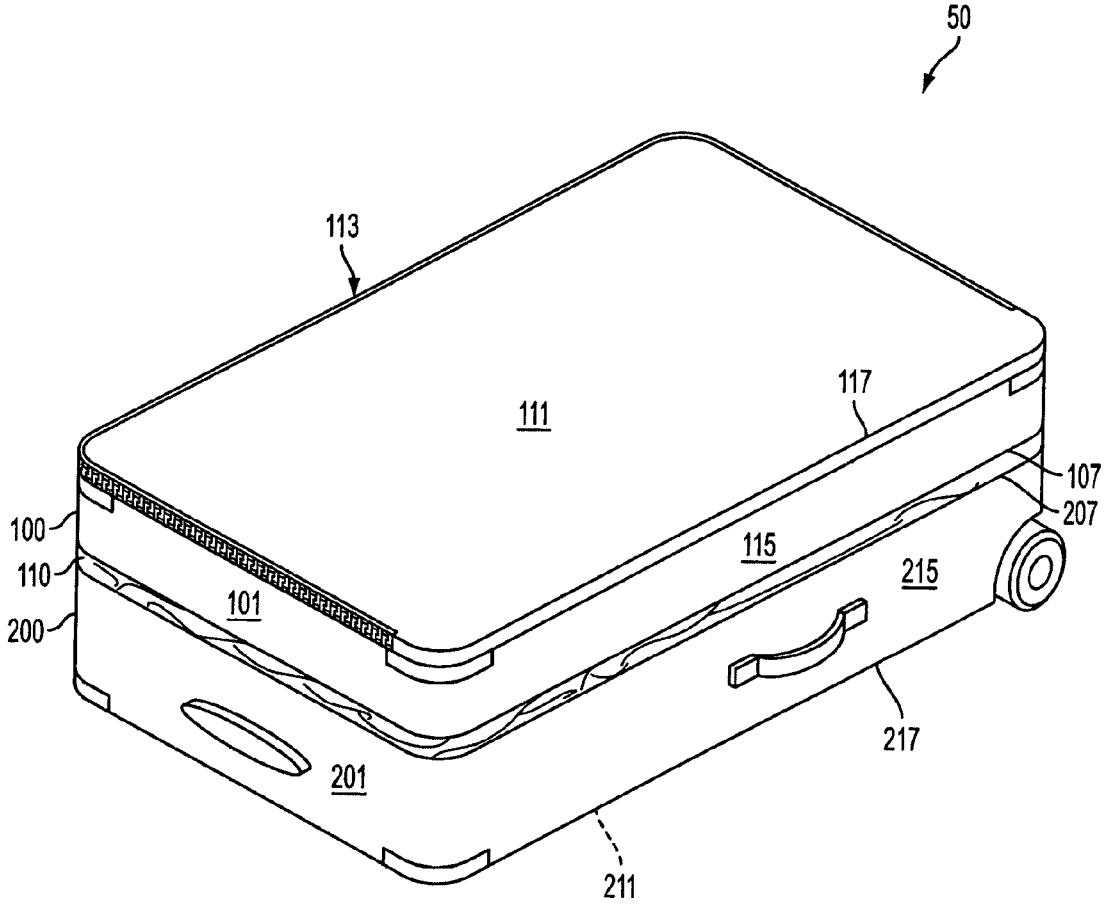
FIGS. 1A and 1B illustrate perspective views of an exemplary embodiment of a piece of expansible luggage, a collapsed position and an expanded position, respectively.
Figure 1B:
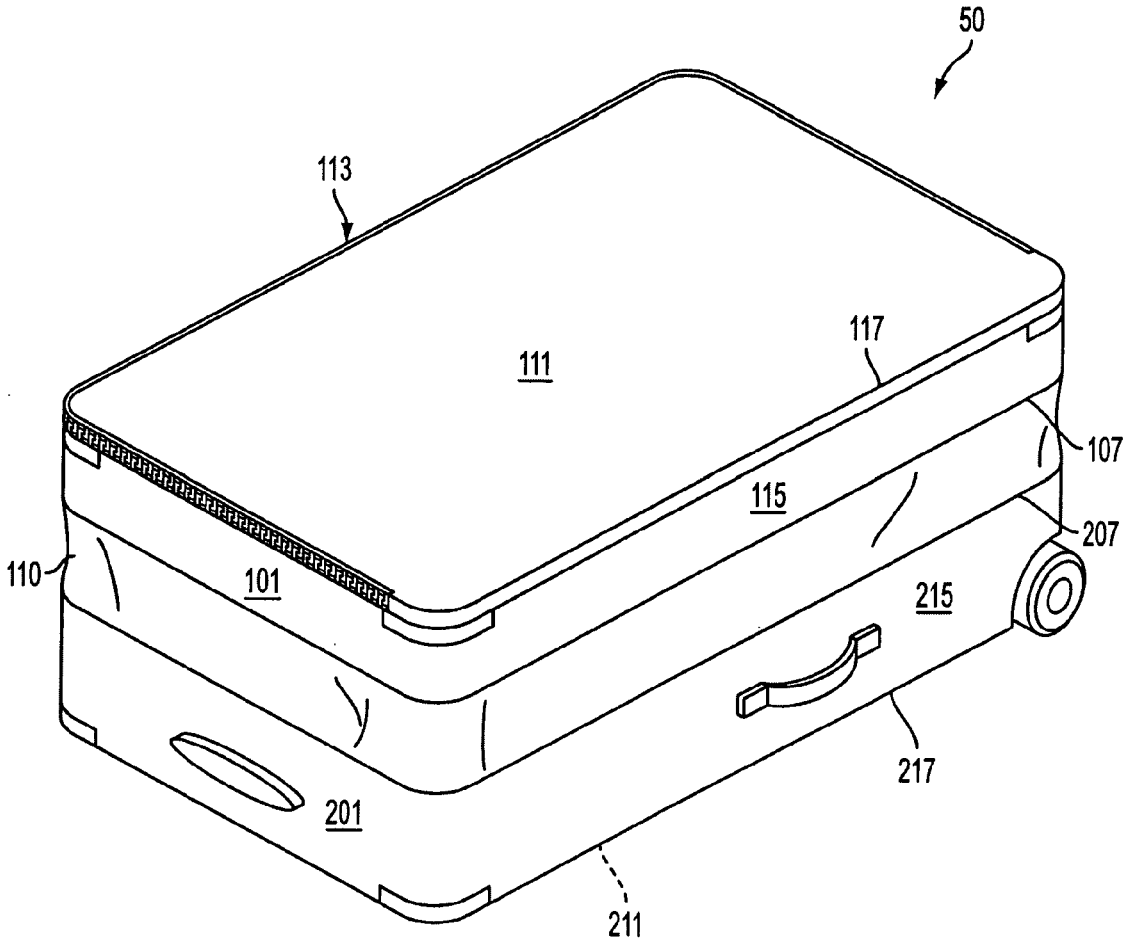

FIGS. 1 and 2 shows an embodiment of a piece of soft-sided luggage (50) including an embodiment of an expansion mechanism (300). FIG. 1A shows the luggage (50) in its collapsed state, FIG. 1B shows the luggage (50) in its expanded state. The luggage (50) depicted is of a soft-side type having wheels for rolling, a telescoping handle, and a carry handle similar to those known to ones of ordinary skill in the art. It generally has a rigid or semi-rigid frame on four of six sides with the frame enclosed on all six sides by fabric, leather, or similar flexible materials. This provides for a decreased weight of the luggage (50) while still allowing it to have a relatively predefined shape. The exact design of the luggage (50) is not critical to the invention, and therefore many elements, such as the wheels and handles, are not discussed here.

In the depiction of FIGS. 1 and 2, the frame of the luggage (50) comprises two semi-rigid frames (100) and (200), each of which is of a generally hollow parallelepiped shape missing two adjacent sides. Each frame has a top panel (101) and (201), a bottom panel (103) and (203), and two side panels (105) (115) and (205) (215). The various portions each have two perimeter edges (107) (117) and (207) (217). The frames (100) and (200) are placed adjacent to each other with the similar panels aligned. As shown in FIGS. 1 and 2, each frame is preferably of generally rectangular shape, but that is by no means necessary.

In the embodiment of FIGS. 1 and 2, each of the frames (100) and (200) is covered on five of six sides by a covering comprised of fabric, leather or other animal hide, or similar flexible materials. This covering covers the four structural panels of each of the frame (100) and (200) and also extends across one of the open sides. The remaining open sides of the two frames (100) and (200) are arranged adjacent each other creating a piece of luggage (50) of generally parallelepiped shape with a single internal volume.

The two frames (100) and (200) are connected to each other by a flap, gusset, strip or panel of fabric, or other flexible material (generally the same material as the covering) (110) attached to both the perimeters (107) and (207) of the frames (100) and (200) at the open sides of the frames (100) and (200) and extending between the perimeters (107) and (207) of the two frames (100) and (200). This strip (110) has a length generally of similar dimension to the length of the perimeters (107) and (207) so that if pulled taut, the strip (110) would essentially have a "four-sided" arrangement similar to that of either frame (100) or (200). The width of the strip (110) is generally preselected based on the size of expansion desired for the resultant luggage (50).

Figure 2A:
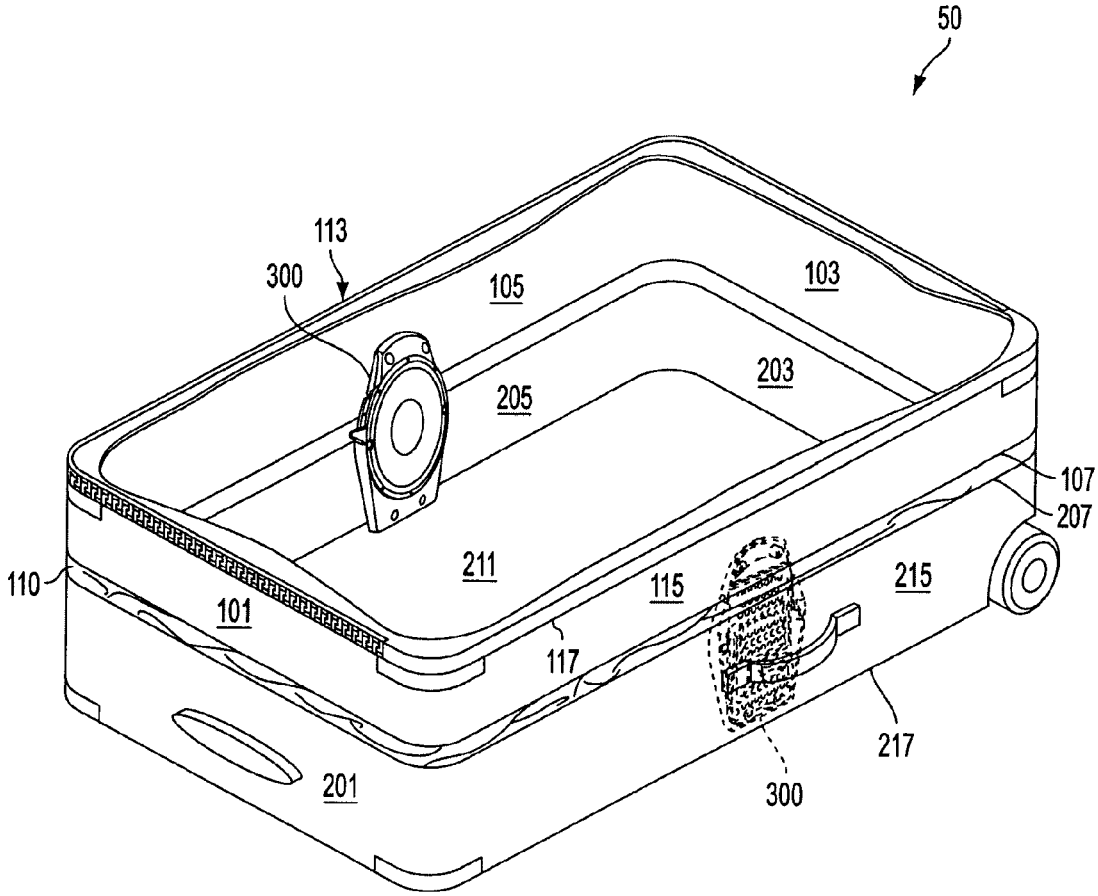
FIGS. 2A and 2B show the luggage of FIGS. 1A and 1B partly broken away to illustrate an exemplary expansion mechanism within the luggage in a collapsed position and an expanded position, respectively.

As can be seen in FIGS. 1 and 2, generally the strip (110) will be folded, bent, stuffed, or scrunched between the two frames (100) and (200) (or extending into or out of the volume of the luggage (50) when the luggage (50) is in the collapsed state and the volume of the piece of luggage (50)) will be approximately the volume of the two frames alone. This is as shown FIGS. 1A and 2A, where the frames are placed in a first relative position at a distance less than the width of the strip (110). The strip (110) may include seams or similar structures to facilitate this folding, if desired.

Figure 2B:
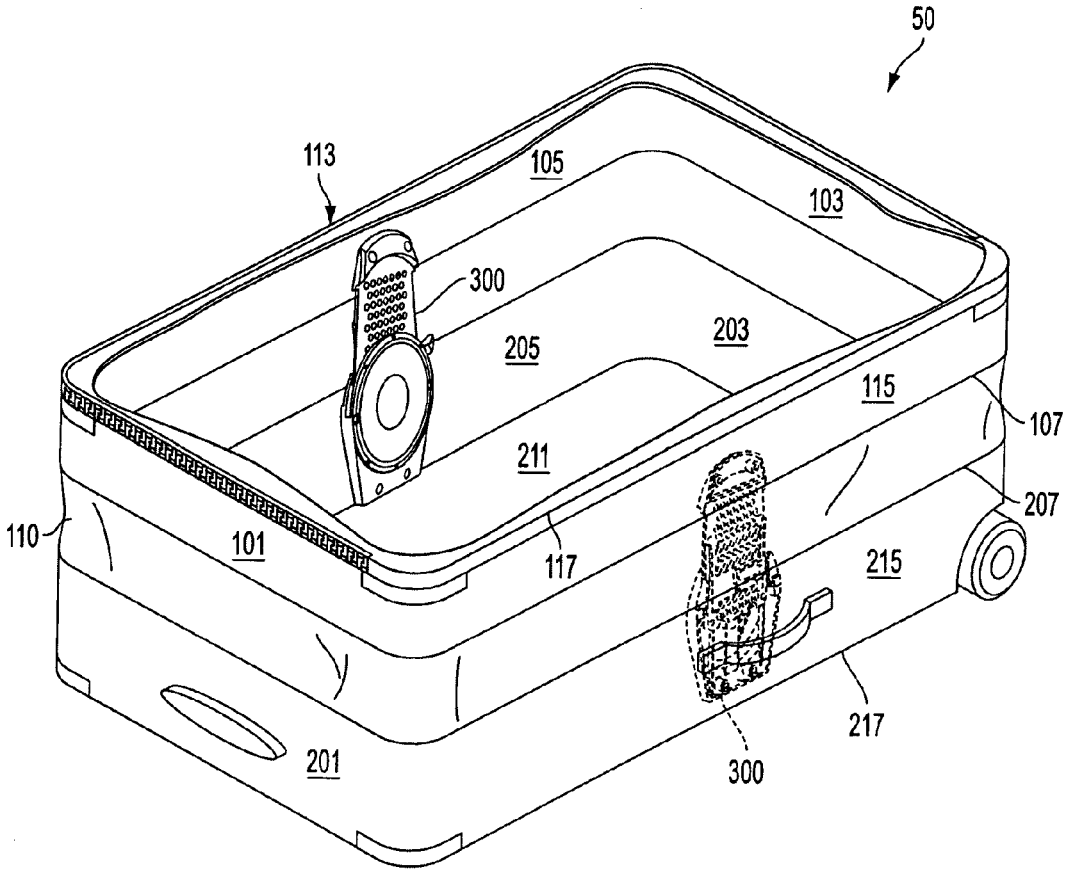

In FIGS. 1B and 2B, the luggage (50) is shown in the expanded or extended state. In this position, the frames (100) and (200) have been separated by a second distance, greater than the first. Further, because of the separation of the frames (100) and (200), the strip (110) is now unfolded or otherwise arranged so as to be extended across the space between the frames (100) and (200). This may preferably be in a relatively taut position, but that is by no means required. As should be clear from the Figures the internal volume of the luggage (50) has been increased in the expanded position compared to the collapsed position, as the strip (110) is now enclosing additional internal volume.

So as to allow a traveler to load the luggage (50) with items, generally there will be a resealable opening into the internal volume of the luggage. It is generally the case that the opening will be on one of the two faces of the luggage (50) lacking frame panels. This arrangement means that the frame is not weakened by the existence of the opening. For general reference purposes, the side including this opening will be called the front face (111 ) of the luggage (50), the opposing side is the rear face (211). In this depicted embodiment, this opening comprises separating the front face (11) on three sides from the luggage (50), the forth side comprising a hinge (generally constructed simply from the flexibility of the covering). The front face (111) can therefore be rotated toward or away from the frame (100) to either close or allow access to the interior volume. The opening also includes a reclosable sealing mechanism (in the depicted embodiment zipper (113)) which allows for the front face (111) to be held in the closed position separating the internal volume from the exterior space.

Because of the positioning of the opening, generally when loading luggage (50), the luggage (50) will be laid on its back face (211) so that the front face (111) and the opening points upward. In this scenario, as should be apparent, gravity will be pulling the frames (100) and (200) toward each other. For this reason, when the frames (100) and (200) are in the expanded position it is desirable to have a device support the frames (100) and (200) in their arrangement in the expanded position. In particular, as the strip (110) is generally flexible, it provides no or little support. In the discussion of the expander it will be presumed that the direction of bringing the frames (100) and (200) closer together is "down" and the direction for moving the frames (100) and (200) apart is "up." These terms are used arbitrarily simply to provide consistency and should in no way be taken as a limitation to the invention.

In order to facilitate the expansion of the luggage (50) between the collapsed and expanded position, within the internal volume of the luggage (50) there is attached at least one expansion mechanism (300) as seen in FIG. 2. In an alternative embodiment, the expansion mechanism may be external to the luggage (50). It is further preferable that at least two mechanisms (300) be used, attached to opposing panels of each frame (100) and (200) in the centers of the panels. In this way, the two frames (100) and (200) can be moved apart from each other, or together, in parallel. As was discussed above, generally when the frames (100) and (200) are moved apart the frames (100) and (200) will be lying parallel to the surface on which the luggage (50) is placed. If only a single expansion mechanism (300) is used, the opposing panel effectively has a lever arm to pull downward which can cause that side of the luggage (50) to not be supported. If expansion mechanisms (300) are centered or otherwise balance on opposing sides, the frame (100) will generally be supported and the remaining sides cannot create a sufficient lever arm to move down as they are equally balanced. If still further support is desired, an alternative embodiment may utilize four expansion mechanisms (300) with one on each panel or arranged towards the corners of the luggage (50) on two panels.

More detailed drawings from a variety of different views of an embodiment of an expansion mechanism (300) are shown in FIGS. 3-6. Generally, the expansion mechanism (300) will comprise two portions which are moveable relative to each other. These portions are generally referred to as the front protective plate (303) and the expansion plate (309). These pieces may be inseparable from each other or may be separable depending on the embodiment. The front protective plate (303) and expansion plate (309) are generally designed and arranged so as to be able to change positions relative to each other in such a manner that the combination of the two pieces becomes larger as shown in the transition from FIG. 3A to FIG. 3B. This expansion is accomplished by the movement of the two components relative to each other. As is known to one of ordinary skill in the art, movement of any one portion is the equivalent to a mirrored motion of the other portion or partial motion by both. For this reason, and for consistency, it will generally be assumed that the front protective plate (303) remains stationary while the expansion plate (309) moves. This is, however, done purely for simplicity of description and because in operation the luggage (50) will generally be open and lying with the back side (211) on a rigid surface. When the pieces are moved, therefore, the surface resists the movement of the back portion (211) of the luggage (50) into it, so the front portion (111) effectively moves upward.

As shown in FIG. 2, so that movement of the two portions of the expansion mechanism (300) is translated into movement of the two frames (100) and (200) relative to each other, one frame (100) will be attached to one portion of the expansion mechanism (300) (in the depicted embodiment the expansion plate (309)) and the other frame (200) will be attached to the other portion (in the depicted embodiment the front protective plate (303)). This connection generally occurs through a rigid attachment preventing the frame (100) or (200) from slipping relative to the portion of the expansion mechanism (300) it is attached to.

In the depicted embodiment, the attachment is accomplished through the use of screws, bolts, rivets, or similar structures. The frame (100) is attached via screws placed through the screw holes (313) in the front protective plate (303) and driven into the panel (105). The frame (200) is attached via screws placed through the screw holes (323) in the reinforcing section (329) of the expansion plate (309) and driven into the panel (205). In the depicted embodiment, a similar expansion mechanism (300) is also attached to the panels on the opposing side. With this attachment, when the front protective plate (303) and expansion plate (309) move away from each other, the panels (115) and (215) to which they are attached also move away. While the operation of each expansion mechanism (300) is preferably independent of the operation of any other expansion mechanism (300), in another embodiment, their operations may be linked.

Returning to the depictions of FIGS. 3–6, the expansion plate (309) moves upward relative to the front protective cover (303) from a first predetermined position comprising the collapsed state to a second predetermined position comprising the expanded state. Generally, the expanded state will be a linear transposition of the position of the collapsed state, however, the transposition need not, and preferably will not follow a strict and perfectly linear path in each transition. As should be apparent from the figures, the two components may simply be pulled apart, however, in order to provide for a smoother transition, and prevent potential damage to the device from the movement, the movement is preferably accomplished through the use of a lifting mechanism (305).

In the depicted embodiment, the lifting mechanism (305) comprises a rotating handle (315) having a pushing pin (317) for interacting with a slot (319) on the expansion plate (309). This is, however, merely one embodiment of a lifting mechanism (305). Generally, a lifting mechanism (305) will comprise any device which is designed to take a force imparted on the lifting mechanism (305) by the user and translate that force into movement of the expansion plate (309). A lifting mechanism (305) is not required in an embodiment of the invention, however, as the two portions of the expansion mechanism (300) may be pulled apart from each other through direct user interaction.

To move the expansion plate (309) using the lifting mechanism (305), a user grasps a handle (315) and rotates it about a particular axis of rotation (311) relative to front protective plate (303). The handle rotates over one of the major surfaces of the expansion plate (309) and under the reinforcing section (329) of the expansion plate (309). The rotation about axis (311) may be created by having a rotation pin (325) located on the handle (315) rotate in a mating hole (335) in the front protective plate (303) or by a similar construction otherwise allowing rotational movement. During this rotation, the pushing pin (317) which is mounted on the handle (315) at a position physically separated from the axis of rotation (311) by a first predetermined distance is rotated about the same axis (311). As the pushing pin (317) rotates, it passes within the slot (319) arranged within the body of the expansion plate (309).

The slot (319) is generally arranged to extend in a generally perpendicular direction to the desired direction of relative motion of the front protective plate (303) and the expansion plate (309). However, as is clear from the figures, the slot (319) may be bent, curved or angled and need not be arranged to have a 90° angle. This is a generally horizontal arrangement in the view of FIG. 3. The slot (319) will generally have a width of dimension similar to the diameter of the pushing pin (317) and will generally have a length significantly greater than the diameter of the pushing pin (317). In this way the pushing pin (317) can slide through the slot (319) along its length, but will contact the upper or lower surface if it is moved in that direction. As would be understood by one of skill in the art, as the handle (315) rotates about the axis (311) which is in fixed relationship to the front protective plate (303), as the pushing pin (317) moves, if it pushes against the slot (319), it will push the expansion plate (309) in the direction of the interaction between the pushing pin (317) and the edges of the slot (319). Therefore, based on the arrangement of the slot (319), the pushing pin (317) will push the expansion plate (309) in a generally linear fashion.

As should be apparent from FIG. 3, the slot (319) does not need to be linear, and in the preferred embodiment, as depicted, the slot (319) will actually have a slight curve or bend to it. This bend can allow for the slot (319) to better track the motion of the pushing pin (317) so that more of the pushing pins' (317) upward motion is transferred to the expansion plate (309) while less side-to-side motion may be transferred. As should be apparent from FIG. 3, the expansion plate (309) does not require any type of rail, guide, or other structure upon which to slide to direct its motion in the correct direction. The interaction of the pushing pin (317) and slot (319) provides for motion in the correct direction. This arrangement creates what is called "float" on the motion. In particular, there is at least one point between the collapsed and extended states where the expansion plate (309) is not in direct contact with the front protective plate (303). As this arrangement includes a floating design, it is not subject to clogging or binding of slide surfaces by lint or other debris.

Figure 3A:
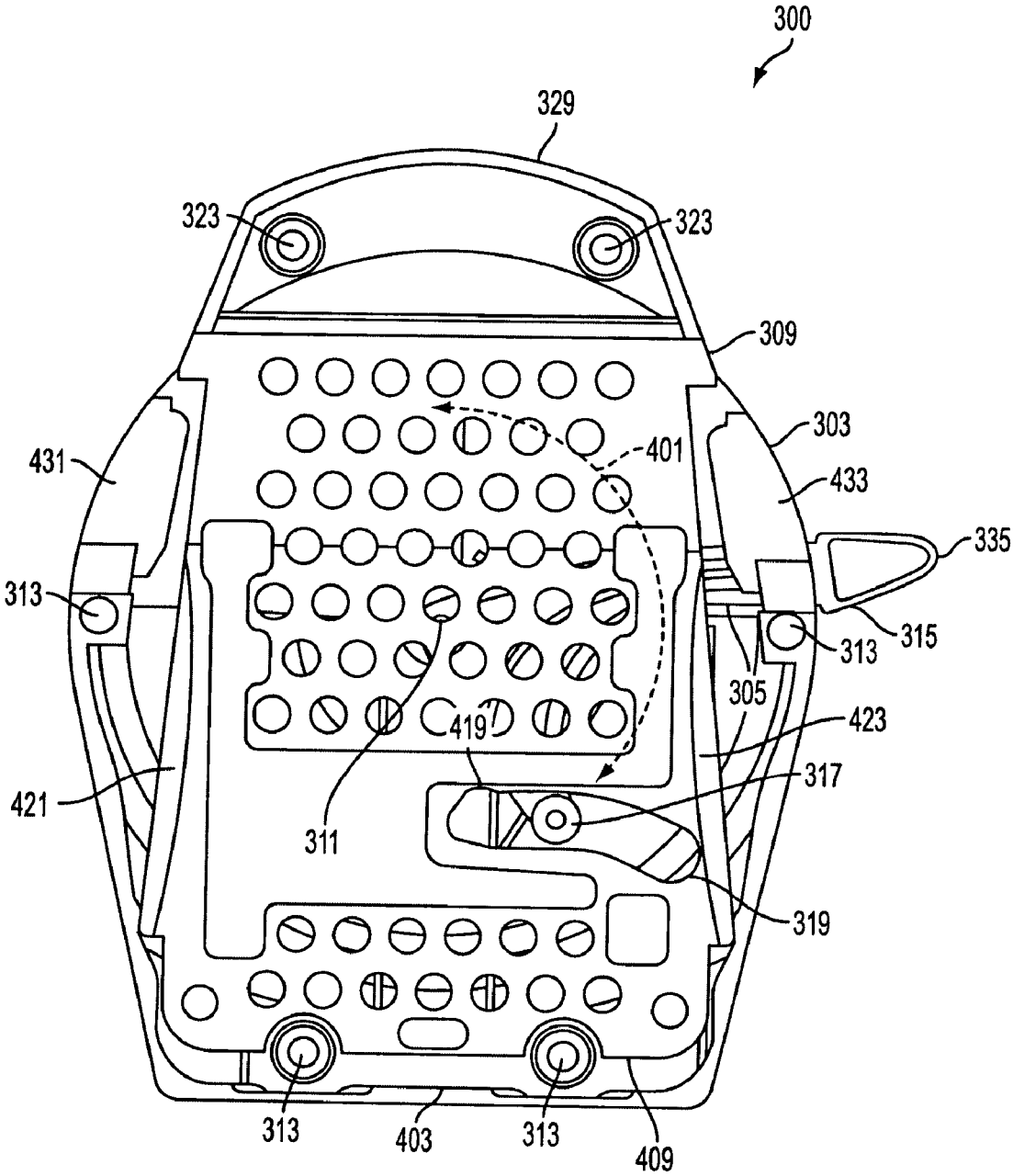
FIGS. 3A and 3B are first side elevational views of the expansion mechanism shown in FIGS. 2A and 2B in a collapsed position and an expanded position, respectively.
Figure 3B:
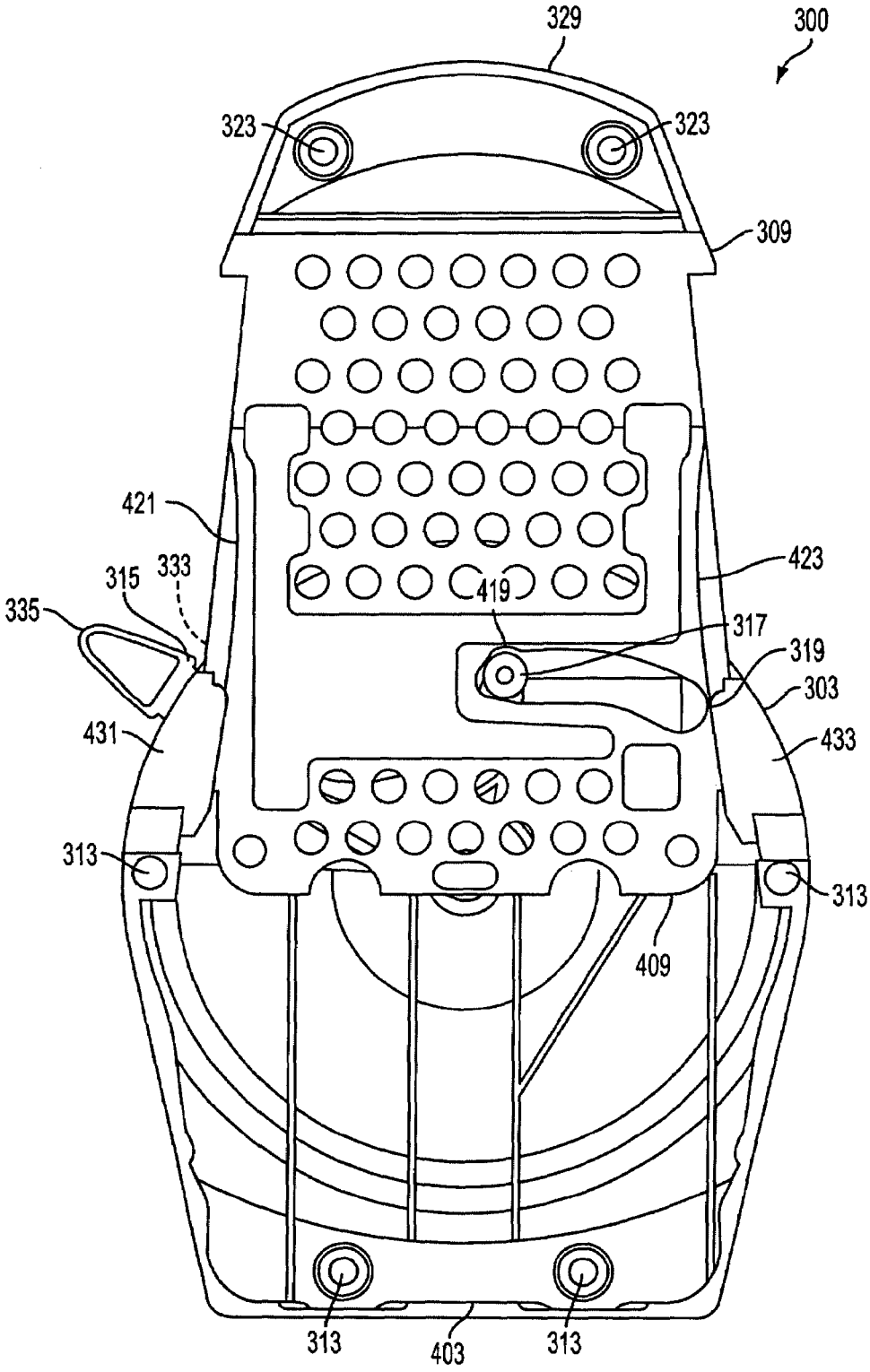

As is best shown in FIG. 3A, as the pushing pin (317) rotates, it traverses an arcuate path (401) about the axis of rotation (311). Because the arcuate path (401) results in both a horizontal and vertical translation of the pushing pin (317) relative to the front protective plate (303) during the motion, the pushing pin (317) serves to move the expansion plate (309) relative to the front protective plate (303).

Figure 4A:
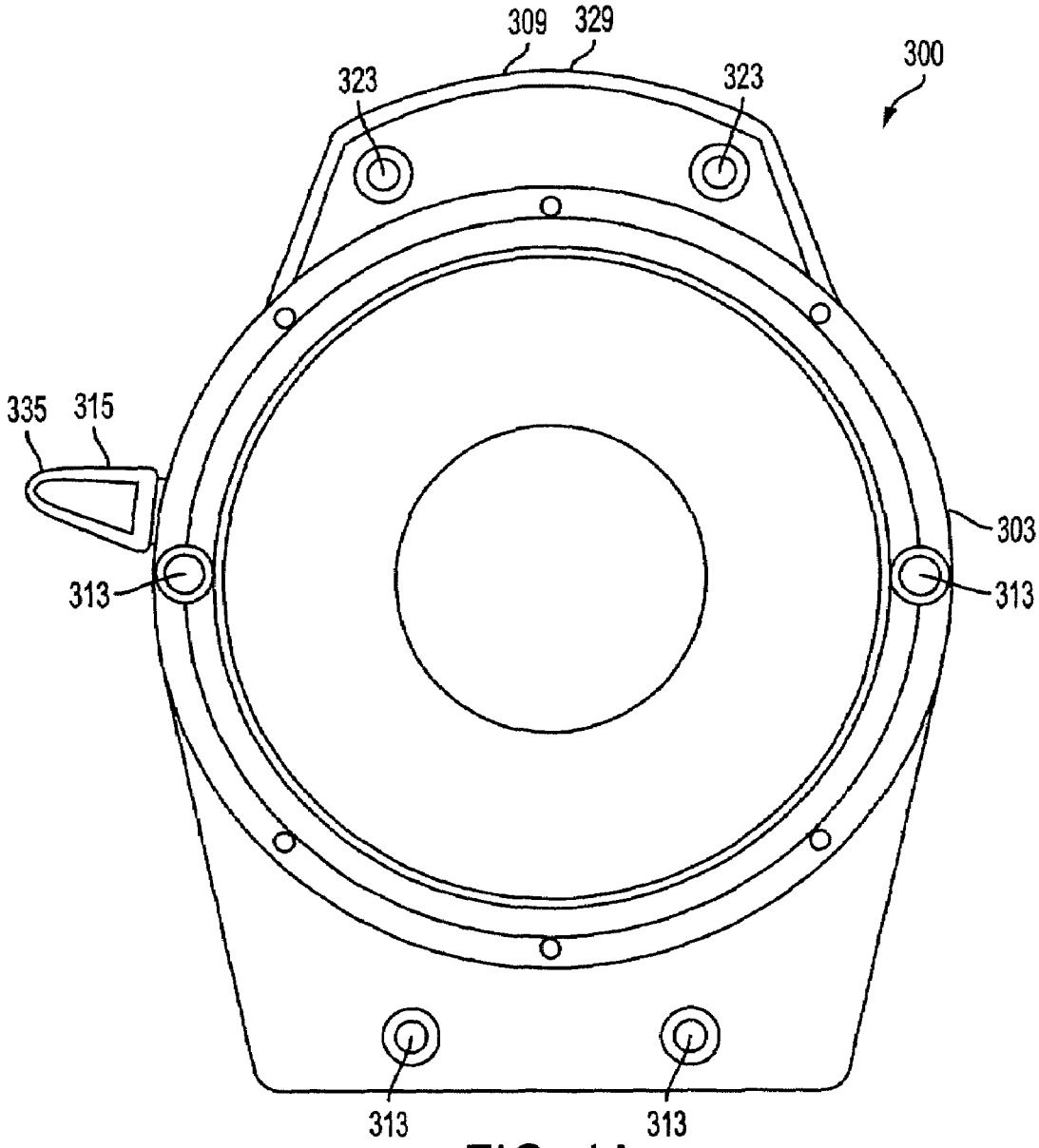
FIGS. 4A and 4B are second side elevational views of the expansion mechanism shown in FIGS 3A and 3B in a collapsed position and an expanded position, respectively.
Figure 4B:
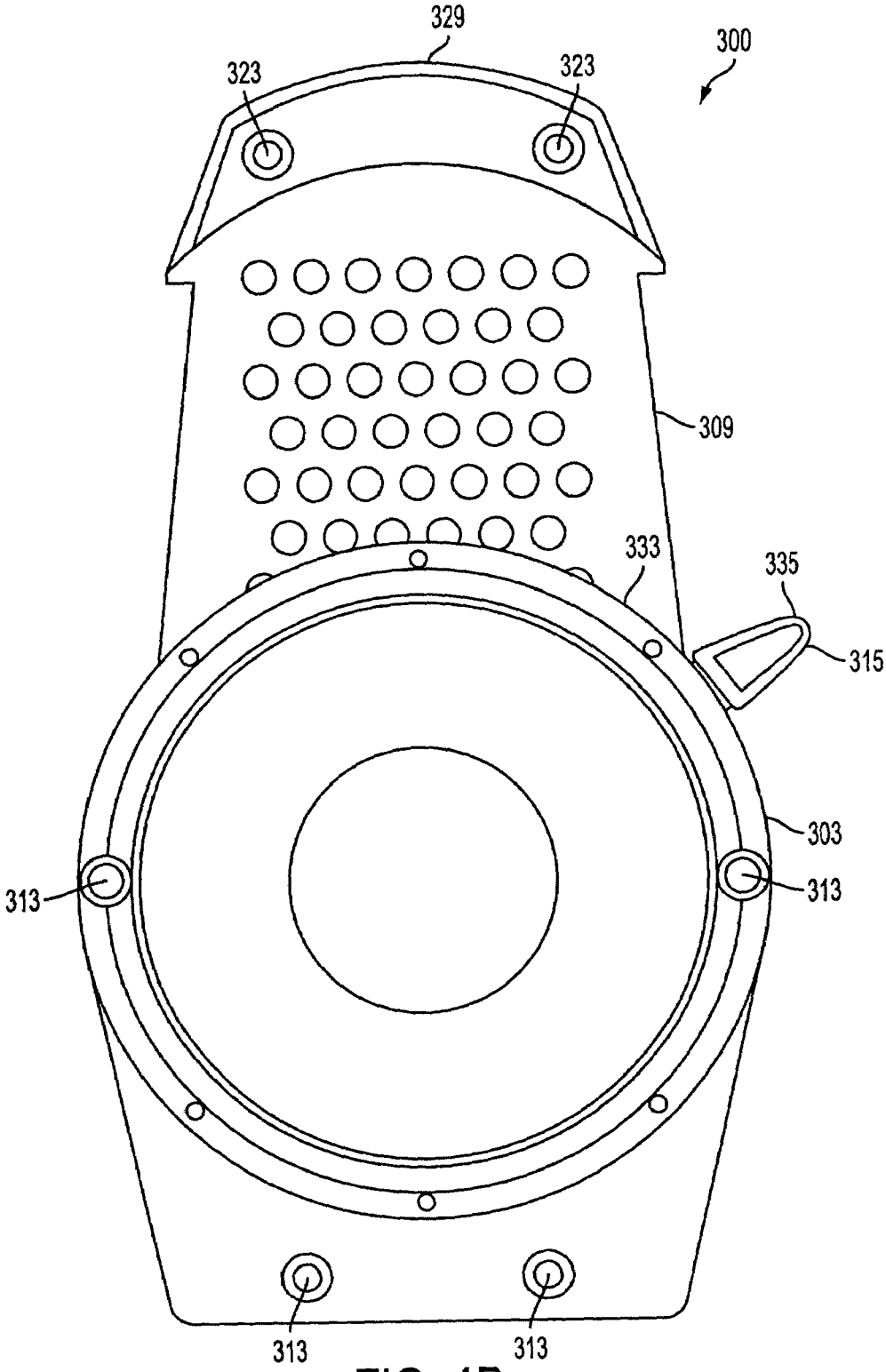

As can be seen in FIG. 4B, once the handle (315) has been fully rotated, the grip portion (335) of the handle (315) has changed sides over the top of the front protection plate (303), and in front of the expansion plate (309) in that figure. Further, as can be seen in FIG. 3, the pushing pin (317) finishes the motion at a position vertically transposed from its starting position and generally also horizontally transposed from its starting position. The expansion plate (309) is therefore moved from its collapsed position to its expanded position.

Figure 5A:
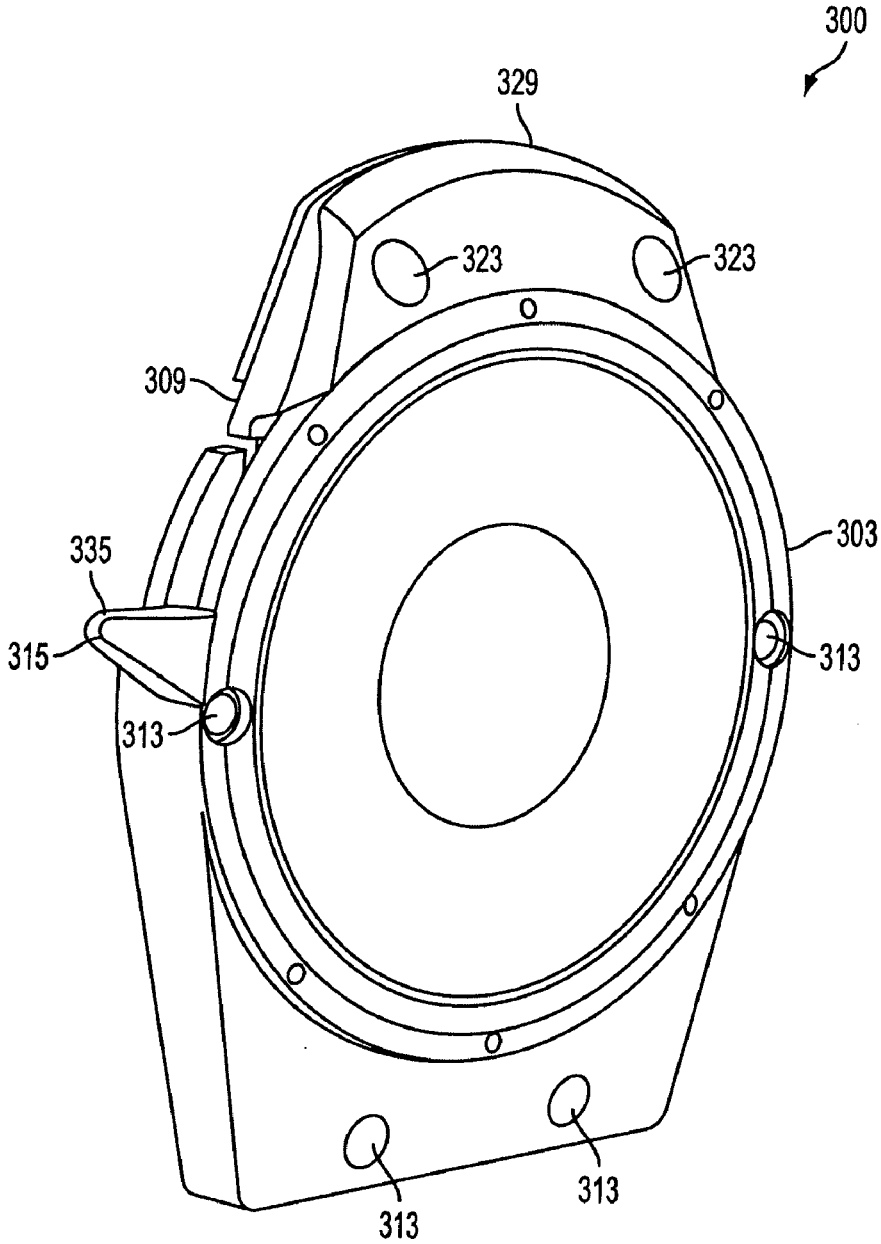
FIGS. 5A and 5B are perspective views of the expansion mechanism shown in FIGS. 3A and 3B in a collapsed position and an expanded position, respectively.
Figure 5B:
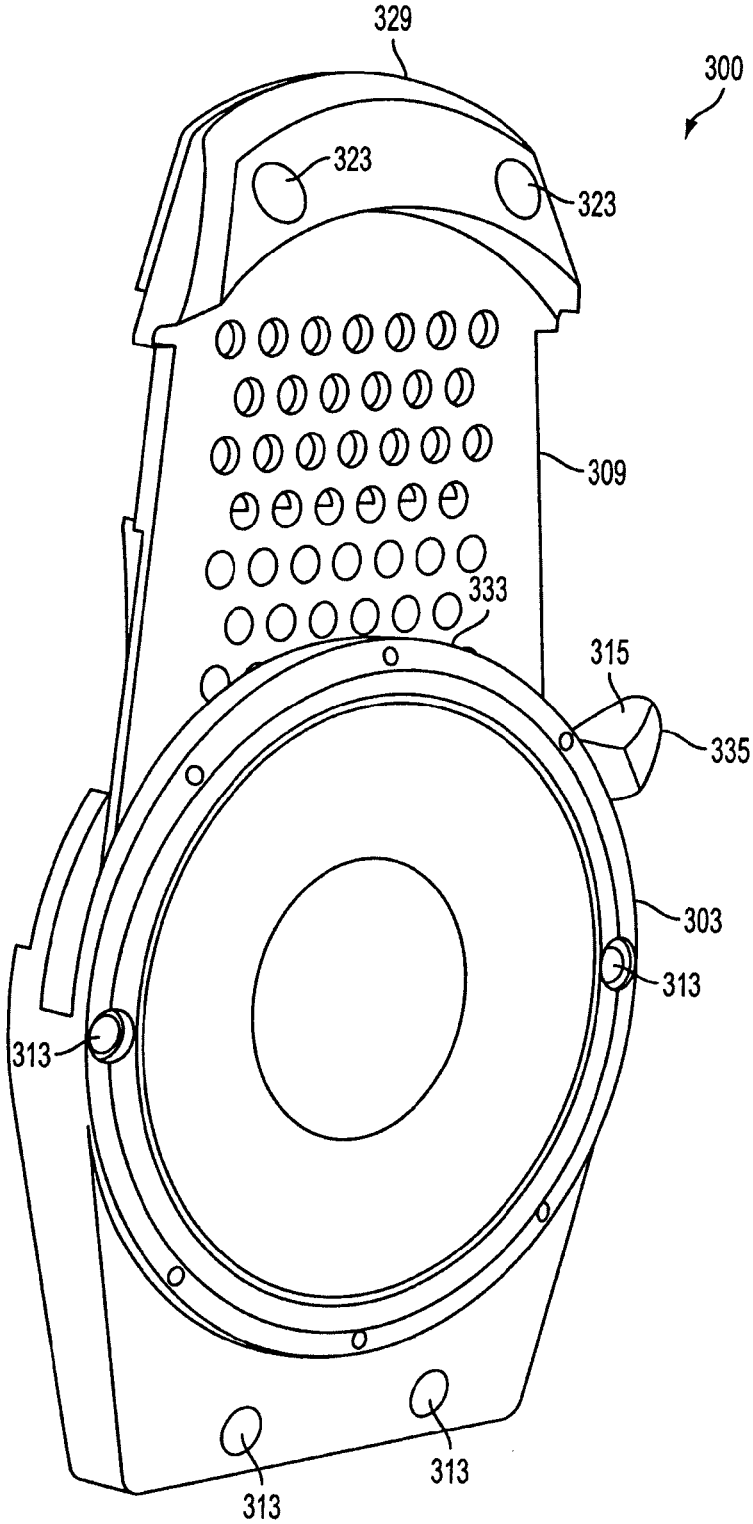

As can also be seen from FIGS. 3–5, because of the movement of the two pieces relative to each other, the screw holes (313) and (323) have also been moved relative to each other, as the screws in those holes were mounted to the frames (100) and (200) and are of generally rigid structure, the frames (100) and (200) are positioned further apart in the expanded position than in the collapsed position as shown best in FIG. 2.

In the collapsed and expanded positions, and between them, there are various different interrelationships between the expansion plate (309) and the front protective plate (303). In the collapsed position, it is desirable for the expansion plate (309) and front protective plate (303) to sit in a relatively stable position relative to one another. In this way, luggage (50) retains a relatively consistent shape and the two structures mutually support each other. To create this steady state, the expansion plate (309) rests against discrete points of the front protection plate (303) as shown in FIG. 3A providing a stable arrangement. The points of contact are preferably on the bottom inside surface (403) of the front protective plate (303) and are in contact with the bottom surface of the expansion plate (309) and or points toward the bottom surface (409) or cut from the bottom surface (409) of the expansion plate (309). The handle (315) may also engage a locking mechanism to prevent unexpected extension.

As can be seen from FIG. 3A, because of the cutouts and non-linear form of the bottom (409) of the expansion plate (309) and the corresponding surface (403) upon which it rests, motion of the expansion plate (309) is generally resisted in all dimensions except the vertical dimension upward (which will be the position the expansion plate (309) moves when moving to the extended position) which may be resisted by the locking mechanism.

This arrangement provides that the expansion plate (309) be constrained at this position to provide for a semi-rigid arrangement of the components in the downward and side to side directions. Further, as the structure of the handle (315) lies in front of the expansion plate (309) and is held by the front protection plate (303), there is a similar semi-rigid holding of the expansion plate (309) in the direction into the page of FIG. 3. In the direction out of the page of FIG. 3, there will generally be attached the frames (100) and (200) and the covering, so that the expansion plate (309) and front protective plate (303) are held in the desired arrangement.

In the extended position, the expansion plate (309) is pinched between two tabs (431) and (433) mounted to the front protective plate (303)). Further, the pushing pin (317) is resiliently detained in a detent (419) at the end of the slot (319). To facilitate the pinching, the expansion plate (309) is generally trapezoidal or otherwise decreasing in width from the top to the bottom in shape and may include cut-outs (421) and (423) arranged within each of the non-parallel sides of the trapezoid. Each of these cut-outs (421) and (423) comprises the removal of a portion of the non-parallel sides to a generally semi-circular, curved, or otherwise bent opening. However, in an alternative embodiment, the cut-out may be linear.

In the expanded position, the expansion plate (309) is essentially retained by a process similar in concept to choking a pathway. In particular, the tabs (431) and (433) are arranged so as to be angled inward toward the top of the front protective plate (303). These tabs (431) and (433) are preferably arranged at an angle relative to each other similar to the angles of the two non-parallel sides of the expansion plate (309) relative to each other. As the expansion plate (309) extends upward through the top (333) of the front protection plate (303), a wider and wider portion of the expansion plate (309) passes between the two tabs (431) and (433), or as in the depicted embodiment, over the two tabs. When the portions are in the collapsed position, it is preferable that the expansion plate (309) not have any contact with the tabs (431) and (433) at all. As the expansion plate approaches the expanded position, the sides of the expansion plate (309), and/or selected surfaces of the cutouts (421) and (423), will both get closer and closer to the tabs (431) and (433).

When the expansion plate (309) has reached the expanded position, the sides of the expansion plate (309) or the cutouts (421) and (423) contact the tabs (431) and (433). Because of the related angles of the sides and tabs (421) and (423), this action generally serves to bind or trap the expansion plate (309) preventing it from moving any higher. This action may be referred to as "stoppering" later in this disclosure as the expansion plate (309) effectively plugs or stops the opening at the top (333) of the front protective plate (303).

The stoppering action serves to prevent any side to side movement at the expanded position as the tabs (431) and (433) will generally be in contact with both sides of the expansion plate (309). In the depicted embodiment, instead of contacting the sides of the expansion plate (309), the tabs (431) and (433) pass behind the sides and interact with the interior walls of the cutouts (421) and (423) for the same effect. As the tabs (431) and (433) are now supporting the expansion plate (309) from behind, in conjunction with the handle (315) placed in front of the expansion plate (309), movement into or out of the page of FIGS. 3 and 4 is prevented. This can be in addition to any support provided by the attached panels of luggage (50).

The only motion not prevented by the stoppering action of the embodiment of FIGS. 3-5, is motion of the expansion plate (309) in the direction toward the collapsed state. This motion is in fact not resisted by the stoppering action at all, other than potentially overcoming an initial friction to separate the expansion plate (309) from the binding of the tabs (431) and (433).

It is desirable that the pushing pin (317) enter a detent (419) within the slot (319), when the expansion plate (309) is in the expanded position. The detent (419) serves to resiliently support the pushing pin (317) in a manner that it cannot be moved back along the slot (319) without supplying an initial force sufficient to overcome the resilient support of the detent (419). This force is preferably greater than the downward force naturally acting on the expansion plate (309) when the luggage (50) is positioned to be loaded, without interference by the user. That is, the force of gravity acting on the expansion plate (309), the frames attached to the expansion plate (309), and any other objects attached thereto is insufficient to push the pushing pin (317) from the detent (419).

The force to overcome the resistance may be supplied in a multiple of different ways. Generally, when the user wishes to collapse the luggage from the expanded state, the user will push the handle (315) grip portion (335) of FIG. 4B back toward the position of FIG. 4A. Their force on the handle (315) will be sufficient to overcome the resilient detention of the pushing pin (317), and once overcome, their rotation of the handle (315) will act to effectively pull the expansion plate (309) down, or control the descent of the expansion plate (309), depending on how much force is being otherwise exerted to return the expansion plate (309) to the collapsed position. Alternatively, a force can be placed directly on the top edge of the expansion plate (309) toward the front protective plate (303). This force would eventually be sufficient such that the pushing pin (317) will be pushed clear of the detent (419) by the slot (319), and the luggage (50) will collapse.

It is important to note, that the pushing pin (317) and detent (419) arrangement does not require unlocking in order for the expansion mechanism (300) to return to the collapsed state. While the expansion mechanism (300) is resiliently detained in the expanded state, so long as that detention is overcome, the expansion mechanism (300) will collapse. That is, the pushing pin (317) will move from the detent (419) so long as a sufficient force is applied in the correct direction and the pushing pin (317) will generally overcome that resilient support without breakage of any component. This is as opposed to a locking mechanism which cannot move from a locked position without damaging a component (e.g. breaking the lock), unless the system is unlocked before movement.

An expansion mechanism (300) in transition between the two positions is shown in FIGS. 7 and 8. In FIG. 7, the expansion plate (309) is supported solely by the pin (317) and is only prevented from motion by the structure of the handle (315). The expansion plate (309) is not in contact with any portion of the front protective plate (303) at this point, but is only in contact with the handle (315) and the frames (100) and (200) which would be on the surface of these figures. Placement of the expansion plate (309) at any point between the collapsed and expanded positions is generally unstable leading to the expansion plate (309) floating between the collapsed and expanded positions and in other dimensions as well. Generally, this float will also depend on force being applied to the two frames (100) and (200) and the handle (315). As can be seen from FIG. 8, at points between the extended and collapsed positions, the expansion plate (309) can tilt, translate, or deflect within certain constraints in the dimension parallel to the plane of the page limited only by the external walls of the front protective plate (303) (which it is preferably not in contact with the expansion plate (309) barring such deflection) and the tabs (421) and (423) (which are similarly not in contact barring such a deflection).

The floating arrangement which exists in transition can provide for numerous benefits. In particular, the floating design allows for the expansion mechanism (300) to absorb a potentially damaging force once the luggage (50) has been packed or is being packed, while still allowing for a fairly rigid arrangement for ease in loading.

As was discussed above, the pushing pin (317) is retained in a detent (419) in the slot (319) when at the expanded position and this resilient support can be overcome simply by placing a sufficient force on the expansion plate (309) in the downward direction (or on the handle (315) in the appropriate rotational direction). In particular, the "stopper" design generally does not prevent the expansion plate (309) from falling downward so long as the handle (315) can rotate and the pushing pin (317) is not detained. Therefore, if a force downward on the expansion plate (309) exceeds the resistance of the detent (419) on the pushing pin (317), the expansion plate (309) will move toward the collapsed position until either the force is removed, cancelled out by another force, or the expansion plate (309) reaches the collapsed position. Further, this forced movement is of such a type that the expansion mechanism (300) is generally not damaged by applying the force.

The float at such an intermediate position also provides for resistance to forces applied to the luggage (50). In particular, a user may extend the expansion mechanism (300) to the extended position if they wish to increase the internal volume of the luggage (50) for a particular trip. However, generally the volume will not be completely filled with rigidly packed objects but will often include compressible objects (such as clothes) and may also have quite a bit of empty space. As should be apparent from FIG.2, in this situation, if a force is applied to the luggage (50) directed to push the two frames (100) and (200) back together, most of the support to keep them apart is the support of the expansion mechanism (300) as the contents do not prevent the motion, the strip (110) does not prevent the motion, and the frames (100) and (200) do not prevent the motion. When luggage (50) is transported in aircraft or other areas, when it is being carried on baggage handling systems, or when it is being handled by baggage workers, it is not surprising for it to be pressed into tight spaces, stacked, or otherwise have large forces imparted upon it. One such force is the force downward (or a compression force) as discussed.

In the event that a downward force is applied to the expansion mechanism (300) of the depicted embodiment, it should be clear that, the device will hold against the force until the force is sufficient for the detent (419) to release the pushing pin (317). At this point the expansion plate (309) will fall into a transition phase as shown in FIG. 7. It is presumed the expansion plate (309) will not reach the collapsed stage in most cases as the contents of the luggage (50) will resist the front face (111) moving downward all the way.

Once in this intermediate stage, as shown in FIG. 8 there is float in the position of the pieces relative to each other, therefore forces will generally simply result in the pieces moving relative to each other as shown in FIG. 8 preventing relatively large shearing or compression forces from causing damage. This can prevent damage to the expansion mechanism (300) as forces applied to the expansion mechanism (300) generally cause the resilient support to simply release, and then the frames (100) and (200) have some space to "wiggle" relative to each other, without damaging any portion of the expansion mechanism (300).

By providing the ability to collapse, damage to the expansion mechanism (300) is more easily prevented as the forces can be absorbed, or can be transferred, or canceled out by forces elsewhere in the luggage. The structure of the expansion mechanism (300) can, therefore, be built using materials which are structurally weaker. These pieces generally have a lighter weight and can allow the resultant luggage (50) to also be lighter. For instance, plastics can be used in place of metals and even lighter or hollow structured plastics can be used in place of more rigid plastics. This makes the luggage (50) easier to carry. Further, even if similar construction materials are used, the luggage (50) can generally absorb much greater force without damage, further improving the functionality. Still further, as the mechanisms are lighter, more of them can be included. For instance four mechanisms (300) may be used for the same weight as two mechanisms of the prior art. In such a system the luggage (50) is both more resilient, and because of the additional mechanism (300) even more resilient to damaging forces.

The embodiment of the figures also provides for numerous other benefits. As the system does not rely on sliding components but free float, even if a component becomes bent or similarly damaged, the expansion mechanism (300) will still usually function. For instance, while the expansion plate (309) is extended, a shearing force may be applied to the upper frame (100) relative the lower frame (200) into the page of FIG. 2. This can bend the expansion plate (309) out of (or into) the page of FIG. 4. If the expansion mechanism (300) slid together, the expansion plate (309) would catch and bind instead of sliding because the plane of the expansion plate (300) is bent. In the expansion mechanism (300) of FIG. 4, however, so long as the handle (315) can be moved between the two positions and the pushing pin (317) is still in the slot (319), the expansion mechanism (300) can be adjusted back to the collapsed position and can continue to transition between states. Further, because of the design of the handle (315), if the user can force the handle (315) to slide in front of the expansion plate (309), it may actually serve to bend the expansion plate (309) back, and to allow for the expansion plate (309) to move even if the bend is quite severe.

The system also provides an additional benefit through the use of the front protective plate (303). As can be seen in FIG. 4 the front protective plate (303) generally covers the front of the expansion plate (309) when the expansion mechanism (300) is in the position of FIG. 4A. Further, the handle (315) is arranged so as to be accessible towards the top (333) of the front protective plate (303).

As a user will often not know that they need the additional space until after they filled the lower portion of the luggage (50), a handle (315) mounted towards the top (333) of the front protective plate (303) allows for easier extension if the volume of frame (200) is already filled with objects. In many items of the prior art, expanding the luggage required the user to have moving parts slide over items which had already been packed or had to reach under the already packed items to unlock the expansion mechanism (300). This sliding could potentially damage both the objects in the luggage (50) and the expansion mechanism (300) and reaching in could be difficult. In the depicted embodiment, the handle (315) is still readily accessible and the objects in the luggage (50) are spaced away from any moving parts so that they neither interfere with the system or are interfered with as the front surface of the front protective plate (303) segregates these components from the contents of the luggage (50).

Still further, there is no "locking" system in an embodiment which needs to be unlocked to allow movement of the two pieces relative to each other. If necessary, the user can simply pull the two frames apart or push them back together. This means that there is no need to have to interact with a locking mechanism or risk damage to the device. In fact, in an embodiment, even if the mechanism was totally inaccessible to the user, it could still be extended.

As is also apparent from FIG. 4, the slot (319) and pushing pin (317) structure is generally inaccessible from the outside in both the collapsed and expanded position. In the collapsed position, the reinforcing section (329) may cover the opening at the top (333) of the front protective plate (303). In the expanded position pushing, the stoppering action has sealed the hole above the slot (319) and pushing pin (317). Because the slot (319) and pin (317) mechanism are behind the front protective plate (303) as is visible in FIG. 4B, it is much harder for dirt or debris to get into the mechanism, and this helps to keep the mechanism from becoming jammed with debris or dust.

The depicted embodiment merely shows one way that an expansion mechanism (300) could be constructed in accordance with the principles of the invention. In particular, it would be apparent to one of ordinary skill in the art that the free floating stopper type construction could be used in conjunction with different types of resilient support mechanisms other than a pushing pin (317) and detent (419). Further, the exact shape of the stopper design is not required and alternative designs which allow for a first stable position and a second different stable position could be used.

In another embodiment, the collapsed position may also be a stopper position instead of the resting position shown in the depicted embodiment. In still a further embodiment, the upper position may not be a stoppered position, but may simply be an upper position disallowing movement in an upper and sideways direction without prohibiting movement downward. For instance pins may extend into corresponding slots that extend downward from above where they are resiliently detained or the bottom of the expansion plate could "socket" into the top of the front protective plate.

While the invention has been disclosed in connection with certain preferred embodiments, this should not be taken as a limitation to all of the provided details. Modifications and variations of the described embodiments may be made without departing from the spirit and scope of the invention, and other embodiments should be understood to be encompassed in the present disclosure as would be understood by those of ordinary skill in the art.

The invention claimed is:

1. A piece of luggage comprising:

a first frame having a perimeter and an open side;

a second frame having a perimeter and an open side;

a strip of flexible material attached to the perimeters of both of said frames such that said first frame and said second frame enclose a volume which can be increased by moving said second frame away from said first frame; and a first expansion mechanism, said first expansion mechanism comprising:

a-protective plate attached to said first frame;

an expansion plate attached to said second frame and coupled to said protective plate, said expansion plate and said protective plate configured for selective positioning relative to one another in a collapsed position wherein said first frame and said second frame are positioned a first distance from one another and in an expanded position wherein said first frame and said second frame are positioned a second distance from one another, said second distance being greater than said first distance; and a lifting mechanism coupled to said protective plate and to said expansion plate, said lifting mechanism configured to position the first frame and the second frame between the collapsed position and the expanded position;

wherein, in at least one intermediate position between said expanded position and said collapsed position, said expansion plate is not in contact with said protective plate.

2. The luggage of claim 1 wherein said expansion plate and said protective plate are resiliently supported in said expanded position and configured to release the expansion plate without damage to said expansion mechanism when subjected to a predetermined force when positioned in the expanded position.

3. The luggage of claim 1 wherein said expansion plate is trapezoidal in shape.

4. The luggage of claim 1 wherein said protective plate defines an opening and said expansion plate is received in said opening, said opening dimensioned to interfere with a portion of said expansion plate when in the expanded position.

5. The luggage of claim 1 wherein said protective plate includes opposite sides, said opposite sides engaging and supporting said expansion plate when in the expanded position and preventing lateral movement of the expansion plate relative to the protective plate.

6. The luggage of claim 1 further comprising a second expansion mechanism attached to said first frame and said second frame at a location opposite said first expansion mechanism.

7. The luggage of claim 1 wherein said protective plate comprises first and second tabs depending therefrom and defining an opening therebetween, said expansion plate being in contact with the first and second tabs on said protective plate when in the expanded position.

8. The luggage of claim 1 wherein said protective plate comprises first and second tabs depending therefrom and defining an opening therebetween, said tabs being angled toward one another and said expansion plate extending between the tabs in the opening, wherein when the expansion plate is moved to the expanded position, the tabs bind opposing side edges of the expansion plate and limit further movement of the expansion plate relative to the protective plate.

9. The luggage of claim 1 wherein said lifting mechanism comprises a rotatably mounted handle defining a pushing pin, said expansion plate defining a slot, said pushing pin located in said slot and moving said expansion plate relative to said protective plate as said handle is rotated.

10. The luggage of claim 1 wherein said lifting mechanism is positioned between said protective plate and said expansion plate.

11. A luggage expansion mechanism comprising:

a protective plate defining an opening at a top edge thereof;

an expansion plate received in said opening and selectively positionable relative to said protective plate from a collapsed position to an extended position and back again; and a rotational lifting mechanism, secured between the protective plate and the expansion plate, said lifting mechanism arranged so that rotation of said lifting mechanism causes said expansion plate to move relative to said protective plate;

wherein, said expansion plate is resiliently detained in said extended position by said lifting mechanism, thereby releasing said expansion plate from the extended position and allowing the expansion plate to move relative to the protective plate without damage to said expansion mechanism when subjected to a predetermined force when positioned in the extended position.

12. The mechanism of claim 11 wherein said lifting mechanism comprises a rotatably mounted handle defining a pushing pin, said expansion plate defining a slot, said pushing pin located in said slot and moving said expansion plate relative to said protective plate as said handle is rotated.

13. The mechanism of claim 12 wherein said slot defines a detent, said pushing pin resiliently retained in said detent when in the expansion plate is in the extended position.

14. The mechanism of claim 11 wherein said lifting mechanism comprises a pushing pin, said pushing pin traversing an arcuate path as said lifting mechanism is actuated.

15. The mechanism of claim 11 wherein said lifting mechanism is positioned between said protective plate and said expansion plate.

16. The mechanism of claim 11 wherein said protective plate comprises first and second tabs depending therefrom and defining the opening therebetween, said tabs being angled toward one another and said expansion plate extending between the tabs in the opening, wherein when the expansion plate is moved to the extended position, the tabs bind opposing side edges of the expansion plate and limit further movement of the expansion plate relative to the protection plate.

17. The mechanism of claim 11 wherein said expansion plate is trapezoidal in shape.

18. The mechanism of claim 11 wherein the expansion plate floats in an intermediate position between the collapsed position and the extended position, thereby permitting internal shifting of the mechanism in use.

* * * * *